United States Patent [19]

Manack

[11] Patent Number: 4,907,245

[45] Date of Patent: Mar. 6, 1990

[54] FURNACE WITH CONVECTION-FREE HOT ZONE

[75] Inventor: Michael J. Manack, Fitchburg, Mass.

[73] Assignee: Vacuum Industries, Inc., Somerville, Mass.

[21] Appl. No.: 335,547

[22] Filed: Apr. 10, 1989

[51] Int. Cl.[4] ..... H05B 3/00

[52] U.S. Cl. ..... 373/110

[58] Field of Search ..... 373/109, 110, 111, 112, 373/113, 114; 219/347, 342, 390

[56] References Cited

U.S. PATENT DOCUMENTS

| | | | |
|---|---|---|---|
| 2,969,412 | 1/1961 | Frank | 373/110 |
| 3,257,492 | 6/1966 | Westeren | 373/113 |
| 4,429,403 | 1/1984 | Hooper | 373/111 |
| 4,612,651 | 9/1986 | Moller et al. | 373/110 |

*Primary Examiner*—Roy N. Envall, Jr.
*Attorney, Agent, or Firm*—Henry D. Pahl, Jr.

[57] ABSTRACT

In the high pressure furnace disclosed herein, convection currents in the furnace hot zone are minimized by bringing electrical feedthroughs for the heating element through a horizontal spacer ring which separates a pressure body and cover. A heat zone defining chamber base has an annular flange which extends to the pressure vessel body and a hot zone cover has a corresponding flange which extends to the pressure vessel cover. The feedthroughs pass in spaced relation between these flanges. As the feedthroughs enter the hot zone through the space between the flanges, a relatively small volume of unheated atmosphere is available to support convection currents stemming from necessary clearances around the feedthroughs where they enter the hot zone.

10 Claims, 1 Drawing Sheet

FURNACE WITH CONVECTION-FREE HOT ZONE

BACKGROUND OF THE INVENTION

The present invention relates to furnaces and more particularly to an electrically heated pressure furnace.

In producing and testing various material, e.g. sintered ceramics, it is often desirable to apply both high temperature and high pressure simultaneously, e.g. 100 atmospheres at 2200 degrees C. Further, it is typically desirable to provide a hot zone of relatively uniform temperature. Uniformity of temperature, however, is quite difficult to obtain at high pressures because of convection currents in the pressurizing atmosphere.

As will be understood by those skilled in the art, the pressure gradient which can drive a convection current for a given temperature differential increases with the density of the atmosphere, i.e. owing to pressurization. While convection currents would be minimal if the hot zone could be constructed as an entirely closed or sealed chamber, this is not practical in most instances since it is usually necessary to provide some clearance around feedthroughs for bringing electrical power to an electric resistance element within the hot zone. As is understood by those skilled in the art, the hot zone is typically enclosed by heat shields made up of spaced layers of tungsten sheet. These sheets are subject to considerable expansion and contraction during heating and cooling and thus it is impractical to provide a tight fit around the feedthroughs.

In constructions utilized heretofore, the necessary clearances resulted in very large heat losses which both increased the power required to maintain a given temperature and exposed elements outside the intended hot zone to excessively high temperatures, often resulting in damage and melting.

Among the several objects of the present invention may be noted the provision of an electrically heated high pressure, high temperature furnace which provides a relatively uniform hot zone; the provision of such a furnace which minimizes heat loss from the hot zone; the provision of such a furnace which requires minimal power to operate at high temperature and pressure; the provision of such a furnace which avoids damage to components outside the heat zone occurring due to convection heat loss from the hot zone; the provision of such a furnace which is highly reliable and which is of relatively simple and inexpensive construction. Other objects and features will be in part apparent and in part pointed out hereinafter.

SUMMARY OF THE INVENTION

Briefly, the furnace of the present invention employs a pressure vessel body which is open at the top, together with a corresponding cover. Within the pressure vessel body is a hot zone defining chamber base which is also open at the top. The chamber base has at its top an annular flange extending to the top of the pressure vessel body. A chamber cover for closing of the top of the chamber base is provided with an annular flange extending to the bottom of the pressure cover. A resistance heater is provided within the chamber base.

Between the pressure body and the pressure cover is a spacer ring through which extends a plurality of electrical feedthroughs. These feedthroughs also extend between the chamber base and cover flanges to the resistance heating element. Convection currents in the hot zone chamber are minimized by the relatively small volume which exists between the flanges.

BRIEF DESCRIPTION OF THE DRAWINGS

Corresponding reference characters indicate corresponding parts throughout the several views of the drawings.

DESCRIPTION OF THE PREFERRED EMBODIMENT

Figures 1, 2:
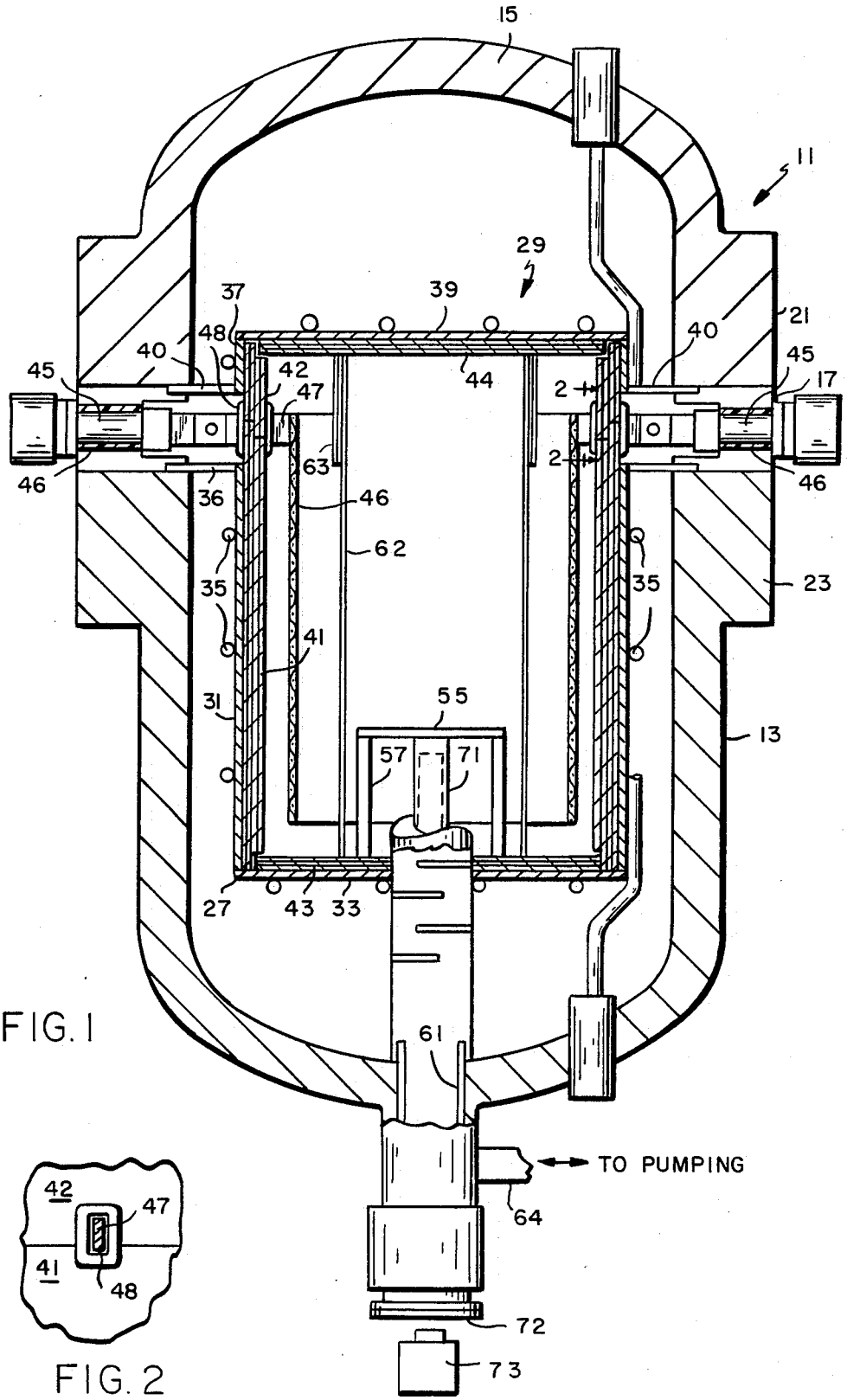
FIG. 1 is a side elevation, with parts broken away, of a furnace constructed in accordance with the present invention.
FIG. 2 is a sectional view, taken substantially on the line 2—2 of FIG. 1, showing an electrical feedthrough passing between heat shields.

Referring now to FIG. 1, the furnace of the present invention employs a pressure vessel, designated generally by reference character 11. Vessel 11 is made up of a cylindrical base or body 13 which is open at the top, a domed or arched cover 15 and a spacer ring 17 which is interposed between the cover 15 and the base 13. The base and cover are provided with rims or flanges 21 and 23, respectively. The flanges 21 and 23 and the spacer ring 17 are apertured at spaced points distributed around the vessel so that the cover and base may be clamped together in pressure retaining relationship by suitable bolts or studs (not shown).

The hot zone of the furnace is defined essentially by a structure involving a chamber base 27 and a chamber cover 29, both of which employ a cooled outer shell, the inner surface of which is lined with heat shielding. The shell of the chamber base 27 is essentially imperforate and includes a cylindrical outer wall 31 and a circular bottom plate 33 both of which are fabricated of copper plate. The outer shell is water cooled by means of tubes 35 soldered to the wall 31 and the bottom 33. A circumferential lip or flange 36 extends to the top of the pressure vessel body, fitting into a recess between the body and the spacer 17. The chamber cover 29, though shorter, is similarly constructed, comprising a cylindrical side wall 37 and a circular top plate 39, also formed of copper. Again, water cooling is provided by means of tubing soldered to the outside of the shell structure. A flange 40 extends to the bottom of the pressure vessel cover 15, fitting into a recess between the cover and the spacer 17.

To support a high temperature differential between the hot zone and the chamber shell, the chamber base 27 and the cover 29 are lined with heat shielding. As is conventional in furnaces of this character, the heat shielding comprise layered tungsten plates or foils. The plates are typically dimpled to provide spaces between adjacent plates and are either wired together or held to the shell portions by tungsten studs. The side shielding for the base and cover is indicated by reference characters 41 and 42 and the shielding for the bottom and top is indicated by reference characters 43 and 44 respectively.

Extending through the spacer ring 17 are a plurality of electric power feedthroughs 45. The feedthroughs are insulated by nylon sleeves 46 where they pass through the ring. A cylindrical tungsten mesh heating element 46 is located within the hot zone chamber and the heating element incorporates a plurality of tongs 47 which extend outwardly to provide electrical connection to the feedthroughs 45. The feedthroughs 45 are copper conductors which are insulated as they pass through the relatively cool pressure vessel, i.e. as indicated at reference character 46, but which are bare or uninsulated within the pressure vessel. The tongs extend out from the hot zone defining chamber at the joint between the base shell element 31 and cover shell element 37. As may be seen in FIG. 1, the heat shielding 41 from the base and the heat shielding 42 from the cover extend towards providing an overlapping joint around most of the periphery of the chamber but openings are provided through which tongs 47 pass with some clearance, i.e. as illustrated in FIG. 2. Boron nitride insulators 48 are provided around each of the tongs 47 where they pass through the heat shields.

At the bottom of the hot zone is a hearth plate 55 mounted on supports 57. The hearth plate and its supports are preferably constructed of tungsten. At the bottom of the pressure vessel is a port, designated generally by reference character 61, through which the pressure vessel may be filled with a suitable pressurizing atmosphere. As is understood, the choice of atmosphere will depend upon the materials being treated within the furnace but typical filling gases include nitrogen, hydrogen and argon. The port 61 is connected to a manifold 64 through which the pressurizing gases may be applied. This manifold can also be connected to a vacuum pump for evacuating the chamber, e.g. as part of a dewaxing cycle as is understood by those skilled in the art.

In order to measure the temperature within the hot zone, the furnace may be provided with a sight tube as indicated at 71. The sight tube may, for example, be constructed of boron nitride and may comprise a tube the upper end of which is closed and in close proximity to the hearth plate or workpiece, e.g. the hearth plate may be apertured. An infrared transmissive window 72 provided at the lower end of the port 61 allows an optical pyrometer, e.g. as indicated at reference character 73, to view up through the sight tube to its closed end and thus obtain a temperature measurement. Since the sight tube is vertical with its closed upper end at the higher temperature, relatively little convection turbulence will occur within the tube to disturb optical sensing. As an alternative, temperature measurements may also be taken by means of bare wire thermocouples hung from the top plate of the cover 29. In that case, the thermocouple wires preferably pass through holes as small as possible in the covered top plate and are provided with very high temperature insulators, e.g. of boron nitride or thoria.

As indicated at the outset, an object of the present invention is to maintain a pressurized hot zone which is as uniform in temperature as possible, particularly through the avoidance of convection currents. As also indicated previously, the ferocity of such convection currents is a function, not only of temperature gradient but also of gas density and therefore pressure. In view of the substantial temperature differences between the hot zone and the space between the heating chamber and the outer pressure vessel, some convection currents will necessarily occur originating at the clearances provided where the feedthroughs pass through the shielding 41 and 42. In accordance with the present invention, however, the actual heat loss occasioned by this convection mechanism is minimized by limiting the volume of the gas mass with which convection exchange can take place. Rather than having the entire volume which exists between the inner chamber and pressure vessel available to support these convection currents, the construction of the present invention limits this volume to only that which exists between the flanges 36 and 40. As may be seen, this is a relatively small volume and thus the heat loss due to convection currents will be correspondingly reduced, as will the convection current velocity. Not only is the power requirement reduced but burning of components outside of the hot zone defining temperature can be substantially eliminated.

A further improvement in heating zone uniformity can be obtained by providing, within the heat zone, a thermal equalizer or distributor. The thermal equalizer is essentially a tube 62 of tungsten plate which rests on the bottom of the chamber. Further, the upper end of the tube 61 is provided with additional tungsten plate shielding as indicated by reference character 63. This shielding is essentially similar to that employed in lining the chamber shell. The main cylinder 61, being thermally conductive tends to distribute the heat vertically in a uniform fashion while the shielding 63 at the top of the tube reduces the amount of heating being coupled from the heating element 46 at the top of the hot zone. This reduces the temperature at the top which, as is understood, tends to be hotter than the bottom of the zone due to the presence of convection currents which cannot be totally eliminated.

In view of the foregoing, it may be seen that several objects of the present invention are achieved and other advantageous results have been attained.

As various changes could be made in the above constructions without departing from the scope of the invention, it should be understood that all matter contained in the above description or shown in the accompaning drawings shall be interpreted as illustrative and not in a limiting sense.

What is claimed is:

1. An electrically heated, high pressure, high temperature furnace comprising:

a pressure vessel body open at the top;

a pressure vessel cover for closing the top of said vessel;

a hot zone defining chamber base open at the top, said chamber base having at its upper end an annular flange extending to the top of said pressure vessel body;

a chamber cover for closing the top of said chamber base, said chamber cover having an annular flange extending to the bottom of said pressure cover;

between said pressure vessel body and said pressure vessel cover, a spacer ring;

within the chamber formed by said chamber base and chamber top, a resistance heating element;

means for admitting a pressurizing atmosphere into the region between said pressure vessel body and cover; and a plurality of electrical feedthroughs which extend through said spacer ring and between said chamber base and cover flanges to said resistance heating element, whereby convection currents in the hot zone chamber are minimized by the small volume between said flanges.

2. A furnace as set forth in claim 1 wherein said chamber base and chamber cover comprise shell portions which are provided with liquid cooling conduits and heat shields which line the interior surfaces of said shell portions.

3. A furnace as set forth in claim 2 wherein said shell portions are water cooled copper and said heat shields are loosely layered tungsten sheets.

4. An electrically heated, high pressure, high temperature furnace comprising:

a cylindrical pressure vessel body open at the top;

a domed pressure vessel cover for closing the top of said vessel;

a hot zone defining cylindrical chamber base open at the top, said chamber base having at its upper end an annular flange extending to the top of said pressure vessel body;

a chamber cover for closing the top of said chamber base, said chamber cover having an annular flange extending to the bottom of said pressure cover;

a spacer ring interposed between said pressure vessel body and the chamber base flange on the one hand and said pressure vessel cover and the chamber cover flange on the other hand;

within the chamber formed by said chamber base and chamber top, a cylindrical resistance heating element;

means for admitting a pressurizing atmosphere into the region between said pressure vessel body and cover; and a plurality of electrical feedthroughs which extend radially through said spacer ring and between said chamber base and cover flanges to said resistance heating element, whereby convection currents in the hot zone chamber are minimized by the small volume between said flanges.

5. A furnace as set forth in claim 4 wherein said chamber base and chamber cover comprise shell portions which are provided with liquid cooling conduits and heat shields which line the interior surfaces of said shell portions.

6. A furnace as set forth in claim 5 wherein said shell portions are water cooled copper and said heat shields are loosely layered tungsten sheets.

7. A furnace as set forth in claim 4 further comprising a cylindrical heat distributor inside of said heating element.

8. A furnace as set forth in claim 7 wherein the upper end of heat distributor is provided with heating shielding for locally reducing the heat received from said heating element.

9. A furnace as set forth in claim 8 wherein said heat distributor and the upper end shielding is tungsten sheet.

10. An electrically heated, high pressure, high temperature furnace comprising:

a cylindrical pressure vessel body open at the top;

a domed pressure vessel cover for closing the top of said vessel;

a hot zone defining chamber base open at the top, said chamber base including a water cooled shell lined with heat shielding, said shell having at its upper end an annular flange extending to the upper rim of said pressure vessel body;

a chamber cover for closing the top of said chamber base, said chamber cover including a water cooled shell lined with heat shielding, said shell having an annular flange extending to the lower rim of said pressure cover;

a spacer ring interposed between said annular flanges and between said pressure vessel body and said pressure vessel cover;

within the chamber formed by said chamber base and chamber top, a resistance heating element;

means for admitting a pressurizing atmosphere into the region between said pressure vessel body and cover; and a plurality of electrical feedthroughs which extend through said spacer ring and between said chamber base and cover flanges to said resistance heating element, the heat shielding lining of said chamber base and cover being extended to bridge the gap between said flange with clearance being provided around said feedthroughs, whereby convection currents in the hot zone chamber are minimized by the small volume between said flanges.

* * * * *